United States Patent [19]

Hsieh

[11] Patent Number: 4,876,808

[45] Date of Patent: Oct. 31, 1989

[54] RUNNING AND CYCLING SHOE

[76] Inventor: Gerald W. Hsieh, P.O. Box 1299, El Toro, Calif. 92630

[21] Appl. No.: 208,487

[22] Filed: Jun. 20, 1988

[51] Int. Cl.[4] ..... A43B 5/14; A43B 5/04

[52] U.S. Cl. ..... 36/131; 36/30 R; 36/129; 74/594.6

[58] Field of Search ..... 36/131, 30 R, 15, 114, 36/129, 135; 74/594.6

[56] References Cited

U.S. PATENT DOCUMENTS

| | | | |
|---|---|---|---|
| 1,041,185 | 10/1912 | Spitz et al. | 36/15 |
| 4,130,947 | 12/1978 | Denu | 36/30 R |
| 4,481,726 | 11/1984 | Phillips | 36/30 R |
| 4,662,090 | 5/1987 | Solano | 36/131 |
| 4,739,564 | 4/1988 | Eser | 36/131 |
| 4,807,372 | 2/1989 | McCall | 36/135 |

FOREIGN PATENT DOCUMENTS

| | | | |
|---|---|---|---|
| 0153210 | 8/1985 | European Pat. Off. | 36/131 |
| 2555417 | 5/1985 | France | 36/131 |

*Primary Examiner*—James Kee Chi

*Attorney, Agent, or Firm*—Plante Strauss Vanderburgh

[57] ABSTRACT

There is disclosed a sport shoe that is adaptable for multiple competitive events. Specifically, the sport shoe is useful for both cycling and running without compromising either competition. The shoe uses clipless pedals which, heretofore, have only been useful with a cleat that is permanently attached to the cyclist's shoes. The shoes can be quickly mounted to the clipless pedal and the wearer can thus compete in running and cycling events without changing footwear. The shoe of the invention has a composite sole with an outer sole, an intermediate sole and a cushioning layer therebetween. The composite sole has a plurality of apertures which are positioned on a preselected array and which receive a plurality of detent members, preferably in the form of upright posts which are permanently affixed to a pedal of a cycle. The upright posts have detent members which snap into the composite sole, thereby firmly securing the shoe to the pedal of a bicycle without any clips or attachment cleats.

8 Claims, 3 Drawing Sheets

FIG. 1
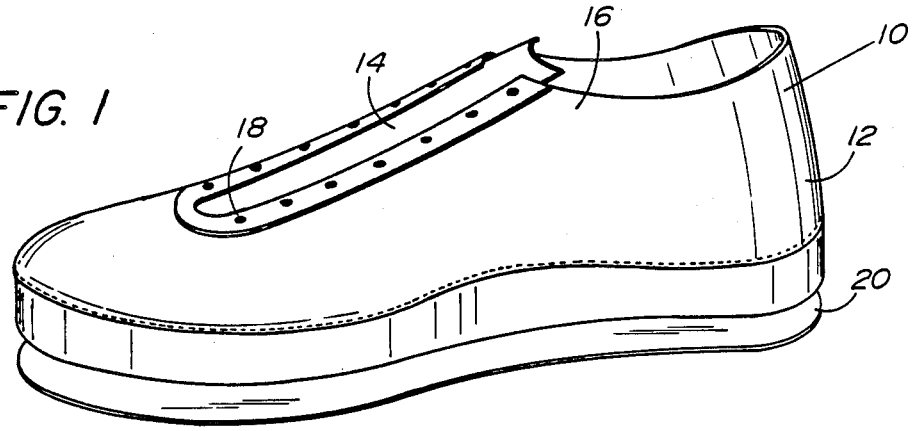
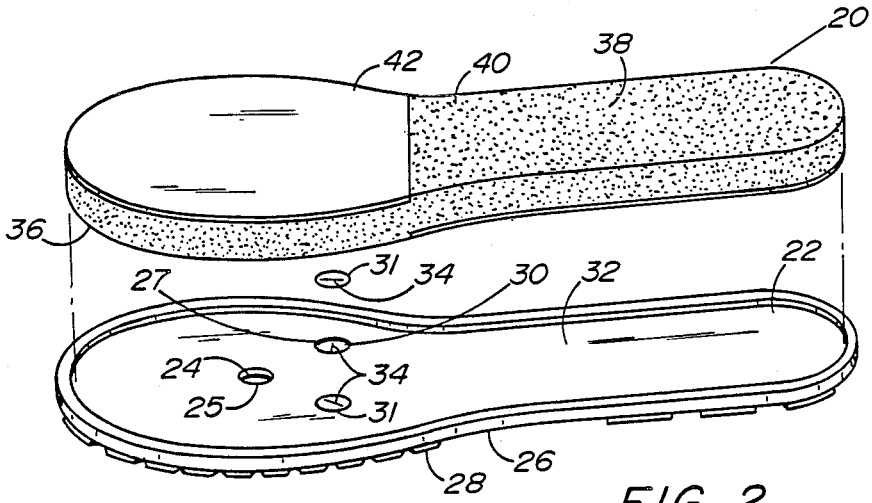
FIG. 2
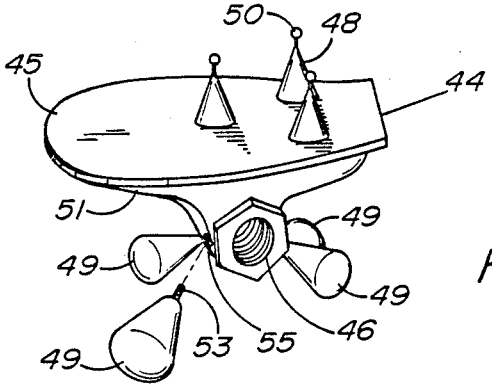
FIG. 3

RUNNING AND CYCLING SHOE

FIELD OF INVENTION

This invention relates to a sport shoe and in particular to a sport shoe suitable for use in triathlon or other events involving running and cycling activities.

BACKGROUND OF THE INVENTION

Sports shoes are increasingly of specialized designs wherein shoes are specifically designed for jogging, marathon racing and the like. Recently, cleats for attachment to shoes have been marketed for use with clipless pedals for competitive cycling. Two brands of clipless pedals have been introduced to the market. Both are quite similar and both are based on a design pioneered by Look, of Nebers, France. The clipless pedals are mounted directly on the crank of the bicycle and have fore and aft grooves which receive cleats that are permanently secured to the undersurfaces of the soles of the cyclist's shoes. The cleats positively engage the clipless pedals and are inserted and removed from the clipless pedals by a twisting action.

Multiple event competition such as the triathlon, Hawaiian Ironman, etc., is finding increasing popularity. Unfortunately, these events have, heretofore, required the competitors to change footwear as there is no universally adaptable footwear for both running and cycling activities. The recently developed cleat and clipless pedal system is not compatible with a running shoe.

BRIEF DESCRIPTION OF THE INVENTION

This invention comprises a shoe that is adaptable for multiple competitive events. Specifically, this invention comprises a sport shoe that is useful for both cycling and running without compromising either competition. The shoe provides the advantage of utilizing clipless pedals which, heretofore, have only been useful with a cleat that is permanently attached to the cyclist's shoes. The shoes can be quickly mounted to the clipless pedal and the wearer can thus compete in running and cycling events without changing footwear. The shoe of the invention has a composite sole with an outer sole, an intermediate sole and a cushioning layer therebetween. The composite sole has a plurality of apertures which are positioned on a preselected array and which receive a plurality of detent members, preferably in the form of upright posts which are permanently affixed to a pedal of a cycle. The upright posts have detent members which snap into the composite sole, thereby firmly securing the shoe to the pedal of a bicycle without any clips or attachment cleats.

Preferably, the receiving apertures in the composite sole have at least one or preferably two, sealing membranes which extend across the apertures and which have single slots to permit the reception of the detent members. These seal members close the apertures and prevent debris and dirt from entering the receptacles during the running activities, thereby keeping these receptacles clean for reception of the detent members.

BRIEF DESCRIPTION OF THE DRAWINGS

The invention will now be described with reference to the FIGURES of which:

FIG. 1 is a perspective view of a shoe according to the invention;

FIG. 2 is an exploded perspective view of the composite sole of the invention;

FIG. 3 is a perspective view of a clipless pedal useful with the invention;

DESCRIPTION OF PREFERRED EMBODIMENT

Figure 4:
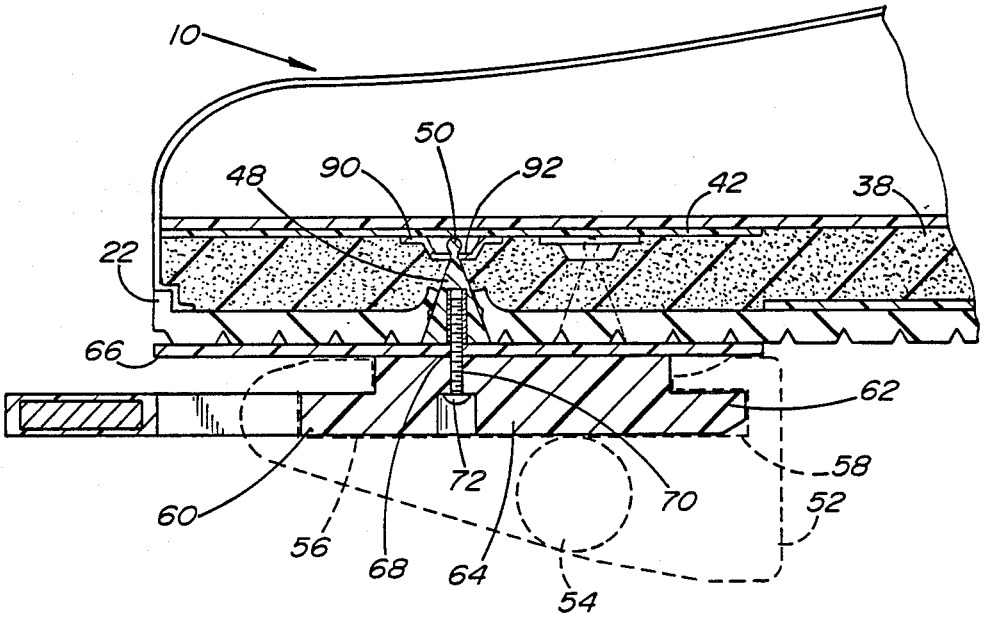
FIG. 4 is a sectional elevational view through the toe of the shoe illustrating the detent members and receptacles.

Referring now to FIG. 1, the invention is illustrated as a fairly conventional appearing sport shoe 10 having a fabric or leather upper 12 formed with a conventional tongue 14 and vamps 16 having a lacing eyelets 18 arranged in a conventional pattern. The upper 12 is bonded to a composite sole 20. Referring now to FIG. 2, the composite sole 20 includes an outer sole 22 having a plurality of apertures 24 which are in a preselected array, e.g., a triangular array. The undersurface 26 of the outer sole 22 has a generally conventional tread with a plurality of traction cleats 28 arranged in a conventional manner as will be described hereinafter with reference to FIG. 6.

The apertures 24 are closed with at least one, and preferably two membrane seals 30 and 31. For illustration purposes, the seals are removed from the forward aperture 25, and the uppermost seal 31 of the aperture 27 is shown removed from the outer sole 22. The membrane seals overlie the apertures 24 and are firmly secured to the upper surface 32 of the outer sole 22. Each membrane seal has a single transverse slit 34 and, preferably, the slits of each pair of superimposed seals are angularly oriented toward each other, i.e., are not coincident. Preferably, two such membrane seals are associated with each of the through apertures.

The outer sole 22 bears against the undersurface 36 of a foam cushion layer 38. The foam cushion layer 38 is conventional in material and structure and can be any suitable closed cell foam such as natural or synthetic rubber, ethylene-vinyl acetate copolymer (EVA), polyethylene, polyvinyl chloride, etc. Preferably, the cushion layer 38 is a compressible, elastomeric, closed cell material. On its upper surface 40, the cushion layer 38 supports an intermediate sole 42 over at least the toe or forward portion of its length. The intermediate sole 42 is of a fairly rigid and strong material, e.g., leather, reinforced plastics such as fiberglass or graphite fiber reinforced polyester, polyurethane, etc. The undersurface of the intermediate sole has a plurality of brackets (not shown in FIG. 2) that will be described with greater detail with reference to FIG. 4. These brackets contain detenting receptacles which are on the aforementioned preselected array, i.e., are coincident with the through apertures of the outer sole.

Referring now to FIG. 3, the shoe of the invention is preferably used with a clipless pedal 44. The clipless pedal is of a unique design for use with shoes of this invention. The shoes of this invention could also be used with other clipless pedals, such as those currently on the market, with a suitable adapter as described hereafter with reference to FIGS. 4 and 5. The pedal 44 has a threaded receptacle 46 for the attachment of a spindle conventionally used for the attachment of pedals to the crank arms of the drive sprockets of bicycles. This pedal 44 preferably has a flat plate 45 which supports a plurality of detent members 48 which are of like number to the through apertures 24 and which are positioned on the same preselected array, thereby permitting the detent members 48 to be received into the receptacles 24 of the outer sole 22 when the shoe is placed on the clipless pedal 44. The detent members 48 preferably snap into the through apertures 24 of the composite sole 20 and, for this purpose, have a bulbous extremities 50 at their upper ends.

Preferably the pedal is weighted to orient plate 45 with the detent members 48 directly upwardly. For this purpose at least one, and preferably four lugs 49 are mounted on the body 51 of the pedal 44. Preferably each lug 49 has a threaded boss 53 which engages a threaded bore in body 51. Each of the bores 55 is oriented at an included angle from about 120 to 260 degrees to the plate 45. The four bores are symmetrically located, side-to-side, to provide the desired balancing to the pedal 44.

Referring now to FIG. 4, the invention is illustrated in a partial sectional view as adapted to a clipless pedal 52 such as that which is currently marketed by Look, of Nebers, France, or by Shimano of Japan. The clipless pedal 52 is illustrated in phantom lines in FIG. 4 and comprises a molded metallic body having a threaded receptacle 54 for the insertion of the spindle used to attach the pedal to the crank arm of a drive sprocket of a cycle. This clipless pedal 54 has a forward slot 56 and a rear slot 58 which face each other, and which receive the tip end 60 and the rear end 62, respectively, of a cleat member 64. The cleat member 64 of the invention is permanently affixed to the underside of a plate 66 on which are permanently positioned detent members 48, such as previously described with reference to FIG. 3. For this purpose, the cleat member has a plurality of through apertures 68 on the preselected array which are aligned with threaded bores 70 in the detent members 48, whereby conventional threaded fasteners 72 can be inserted through the apertures to secure the assembly.

Preferably, the detent members 48 are conical to facilitate their insertion into the through apertures 24 of the shoe 10 and into the locking engagement with the shoe illustrated in FIG. 4. The detent members 48 can be readily inserted as the cushioning layer is elastomeric and will part sufficiently to permit the entrance and withdrawal of the detent members.

The intermediate sole 42 has a plurality of brackets 90 on its undersurface. These brackets correspond in number and spaced array to the detent members 48. Each bracket 90 has a central, raised base which has an aperture 92 to receive the bulbous extremity 50 of a respective detent member 48. The apertures 92 are slightly lesser in diameter than the diameter of the bulbous extremities 50 so that the latter are received by the brackets 90 in a snap fit.

Figure 5:
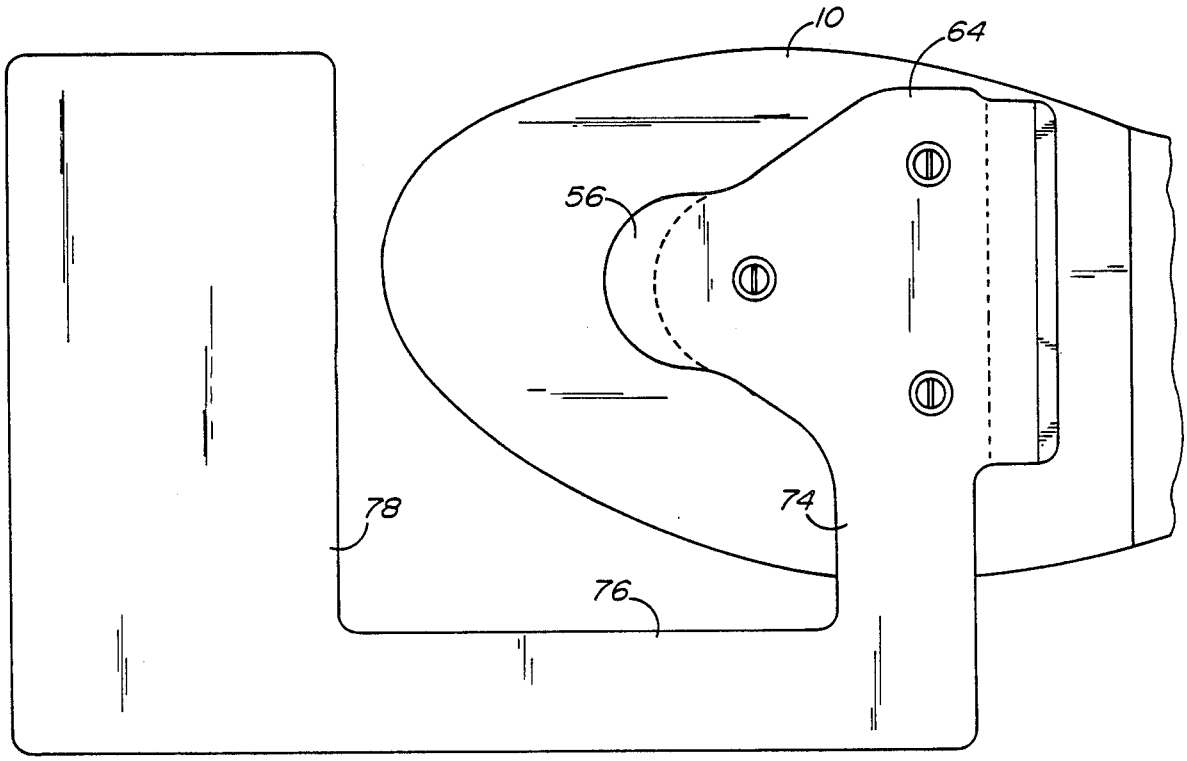
FIG. 5 is a bottom view of the cleat member used in the invention.

The undersurfaces of the cleat member 64 and shoe 10 are illustrated in FIG. 5. The cleat member 64 preferably has a lateral arm 74 with a forward extending arm 76 that supports a counter weight 78. The counter weight is sufficient to maintain the clipless pedal 52 in its open, up position, thereby permitting faster mounting of the cycle. The clipless pedal 52 has the aforementioned forward slot 56 which, as illustrated in FIG. 5, is arcuate thereby providing a pivotal point for the cleat member 64, facilitating its insertion and removal from the clipless pedal. The pedal has a rear slot 57 which receives the rear key 62 of the cleat member 64.

Figure 6:
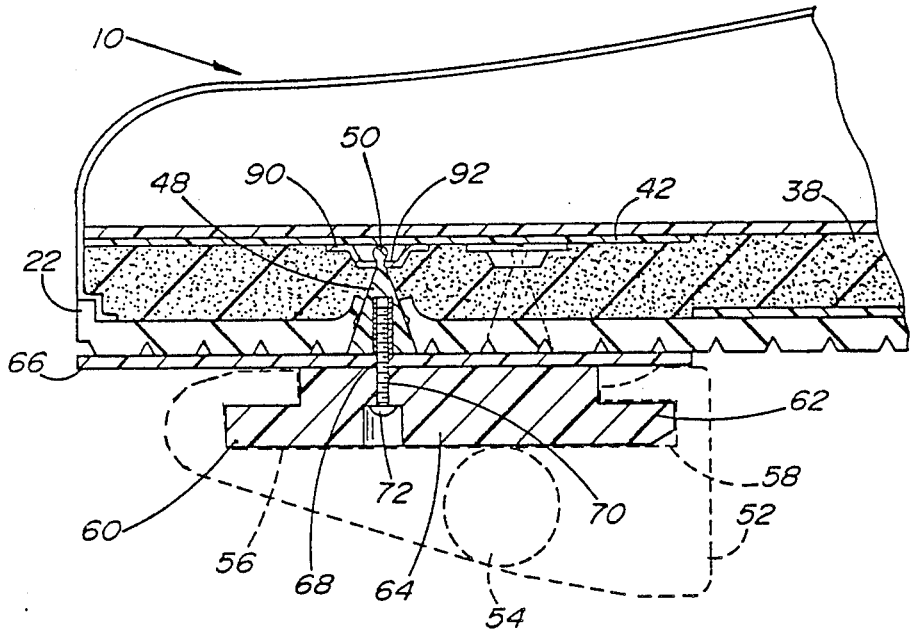
FIGS. 6 and 7 illustrate another embodiment of the invention according to views respectively similar to FIGS. 4 and 5 except without an arm and a counterweight.
Figure 7:
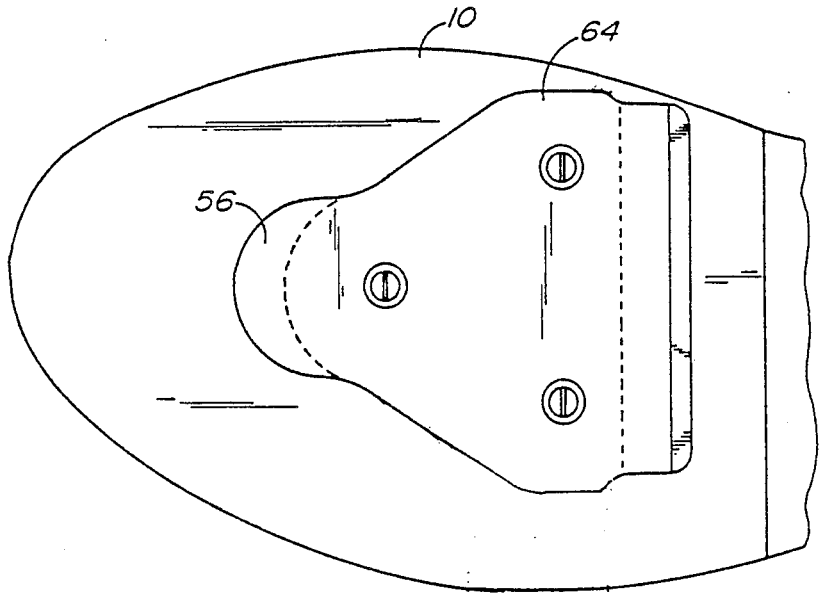

In some applications, it may not be advantageous to have the forwardly projecting arm 76 and counterweight 78. The invention can still be applied to such an application in the manner shown in FIGS. 6 and 7. The elements and construction of this embodiment are essentially the same, and bear the same identifying numbers as those described above with reference to FIGS. 4 and 5, with the exception that the arm 76 and counterweight 78 shown in FIGS. 4 and 5 have been eliminated. In FIG. 6, the shoe of the invention is shown with a cleat member 64 which is substantially identical to that shown in FIG. 4, without the arm 76 and counterweight 78. The cleat member is adapted for use with the clipless pedal 52 previously described with reference to FIGS. 4 and 5.

The invention permits a runner to mount a bicycle immediately, without need to change from running shoes to cycling shoes. The runner simply mounts the bicycle and places the soles of the running shoes over the detent members, pressing the detent members into a firm retention in the mating receptacles in the soles of the shoes. The shoes are instantly linked to the pedals without any clips or straps, thereby minimizing the weight and complexity of the pedals. Although the plates are thus firmly locked to the running shoes, the rider can readily dismount, simply by rotating the plates slightly in the same manner as now practiced with clipless pedals. Once the rider dismounts, the plates can be readily removed from the soles of the shoes by grasping them with one's hand and pulling them from the engagement of the detent members. The invention thus provides for adaptability to running or cycling with minimum delay and effort.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A sport shoe useful for cycling and running which comprises:
   a. a composite sole including an outer sole, an intermediate sole, and a cushioning layer therebetween;
   b. a plurality of through apertures in a preselected array in the toe portion of said outer sole;
   c. brackets on the underside of said intermediate sole, each bracket having a receiving aperture and being positioned on said intermediate sole in said preselected array, whereby each aperture in said brackets is aligned with a respective through aperture in said outer sole; and
   d. aperture seals comprising at least one flexible and slotted membrane extending across each of said through apertures.

2. The sport shoe of claim 1 in combination with a plate for attachment to a pedal mounted on the pedal crank of a bicycle wherein said plate includes:
   a. a plurality of upright detent members positioned its upper surface in said preselected array; and
   b. locking means on the upper ends of each of said detent members of a size and shape to be yieldingly received within said receiving apertures.

3. The sport shoe of claim 2 wherein said locking means comprise enlarged bulbous ends of each of said detent members.

4. The sport shoe of claim 3 wherein said locking means are cooperative with said receiving apertures to be received therein in a snap fit.

5. The sport shoe of claim 4 including a pair of said slotted membranes extending across each of said through apertures with the slots of each pair of said members angularly oriented to the other.

6. The sport shoe combination of claim 2 wherein said plate supports at least one counterweight for balancing said pedal of said pedal crank with said upright detent members on the top surface thereof and facing upwardly.

7. The sport shoe combination of claim 2 wherein said pedal has a central slot with inwardly facing front and rear grooves which receive coacting front and rear edges of said plate.

8. The sport shoe combination of claim 7 wherein said plate is generally triangular with a forward facing apex to permit said plate to be mounted to said pedal by inserting said apex in said inwardly facing front groove and pivoting said plate therein to seat its rear edge in said inwardly facing rear groove of said pedal.

* * * * *